US010300316B2

(12) United States Patent
Hoorelbeke

(10) Patent No.: US 10,300,316 B2
(45) Date of Patent: May 28, 2019

(54) METHOD TO MITIGATE THE CONSEQUENCES OF AN UNCONFINED OR PARTIALLY CONFINED VAPOR CLOUD EXPLOSION

(75) Inventor: Leopold Hoorelbeke, Liège (BE)

(73) Assignee: Total Petrochemicals Research Feluy, Feluy (BE)

( * ) Notice: Subject to any disclaimer, the term of this patent is extended or adjusted under 35 U.S.C. 154(b) by 2349 days.

(21) Appl. No.: 13/054,982

(22) PCT Filed: Jul. 16, 2009

(86) PCT No.: PCT/EP2009/059190

§ 371 (c)(1),
(2), (4) Date: Feb. 6, 2012

(87) PCT Pub. No.: WO2010/010044

PCT Pub. Date: Jan. 28, 2010

(65) Prior Publication Data

US 2017/0225020 A1 Aug. 10, 2017

(30) Foreign Application Priority Data

Jul. 23, 2008 (EP) ..... 08160954

(51) Int. Cl.

| | |
|---|---|
| ***A62C 3/06*** | (2006.01) |
| ***A62C 3/00*** | (2006.01) |
| ***A62C 99/00*** | (2010.01) |
| ***A62C 35/13*** | (2006.01) |

(52) U.S. Cl.

CPC ..... *A62C 3/06* (2013.01); *A62C 3/00* (2013.01); *A62C 35/13* (2013.01); *A62C 99/009* (2013.01); *A62C 99/0045* (2013.01)

(58) Field of Classification Search

CPC .. A62C 3/06; A62C 35/13; A62C 3/00; A62C 99/0045; A62C 99/009; E21F 5/00

USPC ..... 169/43, 45, 54, 58, 61, 64; 299/12

See application file for complete search history.

(56) References Cited

U.S. PATENT DOCUMENTS

| | | | | |
|---|---|---|---|---|
| 2,869,647 | A * | 1/1959 | Mathisen | A62C 99/009 169/58 |
| 3,482,637 | A * | 12/1969 | Kawenski | A62C 3/00 169/61 |
| 5,096,679 | A | 3/1992 | Lake | |
| 5,119,877 | A * | 6/1992 | Sapko | A62C 3/02 169/64 |
| 5,441,114 | A | 8/1995 | Spector et al. | |
| 5,492,179 | A | 2/1996 | Spector et al. | |
| 5,492,180 | A | 2/1996 | Spector et al. | |
| 5,495,893 | A | 3/1996 | Roberts et al. | |
| 5,588,493 | A | 12/1996 | Spector et al. | |
| 5,610,359 | A | 3/1997 | Spector et al. | |
| 7,090,028 | B2 | 8/2006 | Adiga et al. | |
| 7,153,446 | B2 | 12/2006 | Grigg | |
| 2003/0000951 | A1 | 1/2003 | Clark | |

FOREIGN PATENT DOCUMENTS

| | | | |
|---|---|---|---|
| DE | 1127812 | B | 1/1962 |
| EP | 562756 | A1 | 9/1993 |
| GB | 2029215 | A | 3/1980 |
| GB | 2042866 | A | 10/1980 |
| WO | 98-47572 | A1 | 10/1998 |
| WO | 99-24120 | A1 | 5/1999 |

OTHER PUBLICATIONS

Database WPI, Week 200112, AN 2001-111237, Thomson Scientific, London, GB, & RU 2158150 C1 (Perm Kirov WKS), Oct. 27, 2008, Abstract.

* cited by examiner

*Primary Examiner* — Steven J Ganey
(74) *Attorney, Agent, or Firm* — Albert Shung

(57) ABSTRACT

The present invention concerns a method to mitigate the consequences of an unconfined or partially confined vapor cloud explosion due to the accidental release of a flammable gas in an open area, wherein:

means capable to release a flame acceleration suppression product are dispersed in said area, a signal is generated by a detector of said flammable gas release, or by an operator, or by an approaching flame or by the explosion itself, or by any combination thereof, said signal activates the release of the flame acceleration suppression product in said area and in a sufficient amount to transform the flammable cloud into a mixture of flammable product, air and said flame acceleration suppression product to prevent flame accelerations in an unconfined vapor cloud explosion but to let the flammable product burn in case of ignition.

In a specific embodiment the release of the flame acceleration suppression product is made by a signal generated by a detector of said flammable gas release or by an operator and before ignition or beginning of an explosion.

5 Claims, 2 Drawing Sheets

METHOD TO MITIGATE THE CONSEQUENCES OF AN UNCONFINED OR PARTIALLY CONFINED VAPOR CLOUD EXPLOSION

FIELD OF THE INVENTION

The present invention is a method to mitigate the consequences of an unconfined or partially confined vapor cloud explosion by inhibition. A particular hazard for petrochemical plants and refineries is an accidental release of a large quantity of flammable material resulting in the formation of a flammable cloud within the installation. Historical evidence has shown that the ignition of such a cloud can lead to a devastating explosion and a total destruction of the installation. Such accidents are commonly named "Vapor Cloud Explosions" (VCE) or "unconfined vapor cloud explosion" and referred as "VCE".

Flame inhibition refers to a weakening of a flame, that is, a lowering of the overall exothermic reaction rate in the flame. This weakening may or may not lead to extinguishment, depending upon the flow field in which the flame exist.

This is different from fire suppression, flame extinguishment, of flame extinction which are often used to refer to the case in which the flame has been weakened to the point where it can not longer stabilize in the relevant flow field. Flame quenching refers to flame extinguishment for which heat losses to a surface was the precipitating factor.

Inhibition can be achieved by chemical interaction (by an inhibitor) or by cooling (for instance with water). The present invention concerns "inhibition of a accelerating flame in an unconfined vapour cloud explosion by a chemical interaction". The aim is to block the flame acceleration so that the maximum overpressures resulting from the VCE are lowered.

BACKGROUND OF THE INVENTION

U.S. Pat. No. 7,153,446 provides a fire or explosion suppression agent, having two suppressant parts, one comprising an explosion suppressing chemical substance which is substantially liquid at normal temperatures and pressures and the other comprising a fire or explosion suppressing inert gas; the chemical substance being dispersed as a suspension in the inert gas, the chemical substance when so disposed having low environmental impact, with a short atmospheric lifetime of less than 30 days; the chemical substance comprising one or more specific halogenated chemicals. It is not clear whether the fire or explosion suppression agent is released before or after the fire is initiated. The description mentions only the protection of a specified space or volume such as the interior of a vehicle or a volume within an aircraft.

EP 562756 discloses a fire extinguishing and explosion suppression agent comprising perfluorohexane discharged in atomised form, such as, for example, by means of a pressurising gas which may, for instance, be nitrogen at least partially dissolved in the perfluorohexane. It is clear from page 4 lines 23+ that the discharge of the suppressant is triggered by detection of a rise in pressure due to incipient explosion.

U.S. Pat. No. 7,090,028 discloses a method and apparatus for producing an extremely fine micron and sub-micron size water mist using an electronic ultrasonic device that produces the mist at ambient-pressure and delivering the mist for application in suppressing fire. From column 6 lines 50+ it is understood that the mist delivery is made after the beginning of the fire.

WO 99-24120 describes a fire or explosion suppressant comprising water or an aqueous alkali metal salt solution together with a surfactant. The surfactant is selected so as to be fast-acting that is, so that upon dispersion of the water or water-based solution towards the fire or explosion (e.g. in a jet or under atomisation), the surfactant acts to produce a surface tension value which becomes low (preferably at least as low as about 25 mN/m) within the time taken for the dispersed water to reach the fire or explosion (less than 50 and preferably less than 20 milliseconds). The fire or explosion suppression agent is released after the fire is initiated.

WO 98-47572 describes an explosion suppression arrangement for suppressing explosions within a protected area, comprising containing means for containing explosion suppressant material and having an outlet normally closed by frangible means, a source of pressure, pressure distribution means positioned within the containing means so as to be located within explosion suppressant material therein, the distribution means being pressurised by the source upon activation thereof so as to pressurise the suppressant material and break the frangible means to cause discharge of the suppressant material through the outlet. Upon detection of an explosion in the area, the material is discharged into the area and suppresses the explosion. The explosion suppressant material is a powder such as mono-ammonium phosphate or sodium hydrogen carbonate.

US 2003-0000951 provides a method for reducing the severity of vapor cloud explosions in partially confined operating areas, comprising placing porous, high surface-area-to-volume ratio protective material in the area in sufficient amount to reduce the pressure effects caused by ignition of the flammable vapor clouds. According to a preferred embodiment the protective material is a metal mesh or foil material. Examples relate to prevent explosion of a drum containing pentane. The protective material is an expanded aluminum foil, 20 to 80 μm in thickness, of density 30 to 50 kg/m3 and low volumetric displacement (1 to 2%). Said expanded aluminum foil arranged in rolls is inserted in the drum.

U.S. Pat. No. 5,495,893 discloses a deflagration suppression system, which is particularly applicable to deflagrations involving combustible gases. The deflagration suppressant in the system is typically water which is dispersed in the combustible gas as a stream of droplets having a Sauter mean Diameter of no more than about 80 microns. The system can include a combustible substance detector to detect potentially explosive concentrations of a combustible substance, such as the combustible gas, before the onset of a deflagration. By detecting the concentration of a combustible substance in a defined region, the sensing means are able to detect a condition in the defined region that is conducive to the occurrence of a deflagration before a deflagration actually occurs. The dispersing means are thus able to disperse a stream of liquid droplets in the defined region before the occurrence of a deflagration and thereby reduce the likelihood of a deflagration occurring in the defined region.

All these above prior arts don't relate to unconfined vapor cloud explosions.

U.S. Pat. No. 5,096,679 relates to a system to mitigate the effect of an environmental release of a contaminant gas. More particularly, it relates to a system to control the spread of a contaminant gas cloud released into the environment. Specifically, it relates to a system to diffuse and/or neutralize the contaminant gas cloud rendering it less hazardous to the surrounding environment. To elaborate on this aspect, said prior art relates to a system having a plurality of fluid effect devices capable of diffusing, diluting and diverting a cloud of contaminant gas; and further capable of chemically altering the contaminant gas to render it environmentally safe. A method for mitigating the effect of the contaminant gas release also is provided. This prior art is mainly concerned with release of chemicals such as hydrogen fluoride. It mentions introduction of calcium carbonate into a cloud of hydrogen fluoride that in this manner will cause a chemical reaction, thus forming calcium fluoride, a non-toxic mineral precipitate easily absorbable by the ground environment.

This prior art relates to the release of a non flammable contaminant in the environment but is silent on the method to mitigate the consequences of an unconfined or partially confined vapor cloud explosion.

All the prior art is dealing with flame extinguisher or suppression to prevent explosions. The devastating potential of a VCE comes from the acceleration of the flame through the unburnt cloud. The higher the flame speed the higher the overpressure. Under certain circumstances the deflagration can undergo a DDT (Deflagration to Detonation Transition). The current invention consists of introducing a product (or mixture) in the cloud that will avoid acceleration of the flame. This is not a flame extinguisher nor a flame suppression. The result is that the flammable cloud is transformed into a mixture of flammable product, air and flame acceleration suppression product. In case of ignition the maximum potential effect is reduced from a VCE into a "bad" burning flash fire. It means that in case of ignition the flammable gas burns without explosion. An advantage is that the flammable gas has disappeared. The present invention concerns the release of flammable material in open air.

BRIEF DESCRIPTION OF THE INVENTION

The present invention concerns a method to mitigate the consequences of an unconfined or partially confined vapor cloud explosion due to the accidental release of a flammable gas in an open area, wherein:

means capable to release a flame acceleration suppression product are dispersed in said area, a signal is generated by a detector of said flammable gas release, or by an operator, or by an approaching flame or by the explosion itself, or by any combination thereof, said signal activates the release of the flame acceleration suppression product in said area and in a sufficient amount to transform the flammable cloud into a mixture of flammable product, air and said flame acceleration suppression product to prevent flame accelerations in an unconfined vapor cloud explosion but to let the flammable product burn in case of ignition.

In a specific embodiment the present invention concerns a method to mitigate the consequences of an (unconfined or partially confined) vapor cloud explosion, due to the accidental release of a flammable gas in an area wherein:

one or more vessels containing a flame acceleration suppression product are dispersed in said area, said vessels comprise one or more openings closed with rupture disks and means to rise sharply the pressure inside said vessels, a signal is generated by a detector of said flammable gas release, or by an operator, or by an approaching flame or by the explosion itself, or by any combination thereof, said signal activates the means to rise sharply the pressure inside the vessels so as to have the bursting of the rupture disks and the flame acceleration suppression product dispersed in said area and in a sufficient amount to transform the flammable cloud into a mixture of flammable product, air and said flame acceleration suppression product to prevent flame accelerations in an unconfined vapor cloud explosion but to let the flammable product burn in case of ignition.

In a specific embodiment the release of the flame acceleration suppression product is made by a signal generated by a detector of said flammable gas release or by an operator and before ignition or beginning of an explosion.

DETAILED DESCRIPTION OF THE INVENTION

Figure 1:
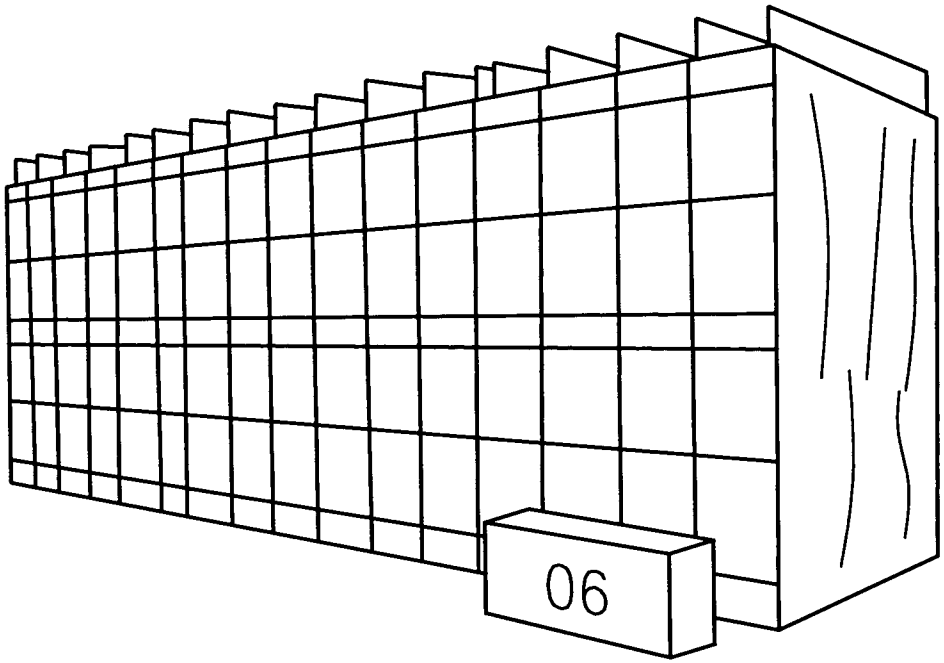
FIG. 1 is a view of a module prior to an explosion test.

Flammable gases are handled in many industrial applications, including utilities, chemical and petrochemical manufacturing plants, petroleum refineries, metallurgical industries, distilleries, paint and varnish manufacturing, marine operations, printing, semiconductor manufacturing, pharmaceutical manufacturing, and aerosol can filling operations, as a raw material, product or byproduct. In addition, combustible gases are released by leakage from above- or below-ground piping systems or spillage of flammable liquids. The invention is of high interest for the refineries and petrochemical plants.

A flammable gas is any gas or vapor that can deflagrate in response to an ignition source when the flammable gas is present in sufficient concentrations by volume with oxygen. Deflagration is typically caused by the negative heat of formation of the flammable gas. Flammable gases generally deflagrate at concentrations above the lower explosive limit and below the upper explosive limit of the flammable gas. In a deflagration, the combustion of a flammable gas, or other flammable substance, initiates a chemical reaction that propagates outwards by transferring heat and/or free radicals to adjacent molecules of the flammable gas. A free radical is any reactive group of atoms containing unpaired electrons, such as OH, H, $CH_3$, R., ROO. et al. The transfer of heat and/or free radicals ignites the adjacent molecules. In this manner, the deflagration propagates or expands outward through the flammable gas generally at subsonic velocities in the unburnt gas. The heat generated by the deflagration generally causes a rapid pressure increase in confined areas. The combustion is a chain reaction that consist in four steps: initiation, propagation, branching and termination.

The initiation step is responsible for the initial decomposition of the reactants and involves formation of radicals. The initiation step is slow and involves thermal of photochemical dissociation. During the propagation step, the reactive intermediate species reacts with the stable species to give a radical of chain carrier. An elementary reaction is considered as part of chain branching when the collision between reactive species and stable species give rise to two reactive species. It is mainly the chain branching steps that are responsible for the occurrence of an explosion. In chain termination steps, the reactive species react to stable species.

During these 4 steps various radicals are formed such as R., ROO., H., OH., . . . . The chain branching step is very important as it determines the explosive character of the combustion. The main action of the inhibitor is to capture chain carriers (mainly H. and OH.) so that the chain branching rate is lowered. There will also be additional physical actions (such as cooling and adsorption) which could lower the reaction rates.

After release, the flame acceleration suppression product not only dilutes the oxygen available for the combustion of the flammable gas but also impairs the ability of free radicals to propagate the deflagration. The dilution of the oxygen decreases the concentration of the oxygen available to react with the flammable gas and thereby slows the propagation rate of the deflagration. The flame acceleration suppression product impairs the ability of free radicals to propagate the deflagration by reacting with the free radicals released in the combustion reaction before the free radicals can react with combustible gas molecules adjacent to the deflagration.

While the method of the invention can be employed to suppress deflagrations associated with flammable gases, the method is particularly applicable to suppressing deflagrations of flammable gases having combustion temperatures ranging from about 500° C. to about 2500° C. Such flammable gases include ethylene, propylene, propane but also benzene, ether, methane, ethane, hydrogen, butane, propane, carbon monoxide, heptane, formaldehyde, acetylene, ethylene, hydrazine, acetone, carbon disulfide, ethyl acetate, hexane, methyl alcohol, methyl ethyl ketone, octane, pentane, toluene, xylene, and mixtures thereof.

The flame acceleration suppression product is any product which captures the free radicals and as such limits the branching reactions. The result is that the flame acceleration is altered and that a devastating explosion is mitigated. The flammable gas will burn more slowly and not develop in a devastating explosion in case of an ignition. The flame acceleration suppression product should not create an important risk (e.g. toxic) for humans or the environment. The flame acceleration suppression product can be a gas, a liquid or a solid (advantageously in a powder form and preferably in a dry powder form). Advantageously the acceleration suppression product is dispersed in the area by a carrier gas originally contained in the vessel. The flame acceleration suppression product is advantageously a metal compound such as, by way of example, a salt. Several products (salts) and mixtures have been tested. The aim of the flame acceleration suppression mixture is to allow capture of different type of radicals. Some compounds in the mixture capture He (hydrogen radicals) or OH. (hydroxyl radicals) radicals while other capture for instance Re (alkyl radicals), RO. (alkoxy radicals) or ROO. (peroxy radicals). Some of the compounds release $CO_2$ while bounding with radical and this gives an additional dilution effect. Two series of experiments have been performed at SOTRA (Norway) by an independent organisation in a 50 $m^3$ module (8 m×2.5 m×2.5 m). A first series of 29 tests were performed in June 2008 and a second series of 14 tests were performed in September 2008. Pressure reduction up to 90% have been obtained so far. Additional tests will be performed in 2009 to improve the effectiveness but it was demonstrated that the mechanism works. A series of tests were done at the University of Bergen in a 20 l vessels. These tests should allow to develop mathematical equation that enable to quantify the effect of the different parameters (influence of concentration, etc.). The man skilled in the art can easily, by routine experiments, select convenient flame acceleration suppression products. It would not depart from the scope of the invention to use a mixture of two or more flame acceleration suppression products. The quantities to be used can vary in a wide range and can be from 50 gr/$m^3$ to 500 gr/$m^3$ advantageously from 200 to 400 gr/$m^3$.

By way of example of flame acceleration suppression products, one can cite sodium bicarbonate ($NaHCO_3$), potassium bicarbonate ($KHCO_3$), sodium chloride and sodium carbonate. The flame acceleration suppression product can be mixed with primary anti-oxidants (ROO. and RO. capture) and/or secondary antioxidants (R. capture).

The vessels containing the flame acceleration suppression product are dispersed in the area to be protected. Number of vessels, location of each vessel, amount of the flame acceleration suppression product in each vessel are linked to speed of dispersion of the flame acceleration suppression product in the flammable gas vapor cloud and the amount of flame acceleration suppression product to be dispersed in the flammable gas vapor cloud.

About the means to rise sharply the pressure inside said vessels it can be a $CO_2$ cartridge or an explosive like the airbag system in the cars. Said $CO_2$ or the gases generated by the explosives can be the carrier gas. Said means are known per se.

About the signal to activate the means to rise sharply the pressure inside the vessels this signal and said means are known per se.

Important factors for success for the method are:

Right time for activation;

Reliability of the system;

Coverage;

Persistence;

Safety for the people

Explosion mitigation capability flame acceleration suppression product (FASP).

Ideally the activation has to be done at the most optimum instant that is: After a certain time in order to give people the possibility to evacuate the unit; A certain time after the occurrence of the leak to enable the flammable cloud to be formed; Long enough before the moment of ignition to ensure that mixing can take place.

The flame acceleration suppression product has to remain airborne in the cloud as long as the risk of a VCE is possible.

EXAMPLES

In the following examples the flame acceleration suppression product is designated as inhibitor or mitigating agent.

The Explosion Vessel and Test Scenario Configuration

The experiments were performed in an explosion test module. The module is 8.0 m long, 2.5 m high and 2.5 m wide, thus having a volume of 50.0 $m^3$. The module has a coarse steel grating forming a mezzanine deck 1.25 m above the floor of the vessel. Some of the standard objects (obstructions) inside the module were removed in order to produce the desired explosion loading scenario for the tests. FIG. 1 shows the module prior to an explosion test.

The locations and measurement positions within the module are described using an x-y-z coordinate system with the origin defined as the south-east (front left) corner at lower deck floor level. The compass directions are also used to denote positions and boundary locations for the module. The front wall (Plexiglass®) is facing east and the inhibitor dispersion system was mounted in the roof of the module, between the centre and south end.

The floor, roof and back wall of the module were all closed. Explosion venting occurred through the ends of the module for most tests (high confinement). A second venting scenario was also used for a limited number of (reference) tests in which the central section of the front wall was also open (low confinement). These vent areas were covered with thin plastic foil to keep the explosive gas inside the module during gas cloud preparation. The plastic foil was clamped in place using a pneumatic retaining system and was released just prior to ignition to allow it to be easily brushed aside by the ensuing explosion.

The ignition source was located near the south (left) end of the module in order to maximise flame propagation distance.

Inhibitor Dispersion System

Figure 2:
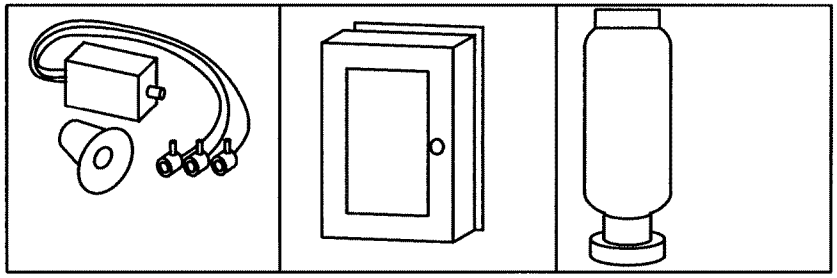
FIG. 2 depicts components of an explosion suppression system.
Figure 3:
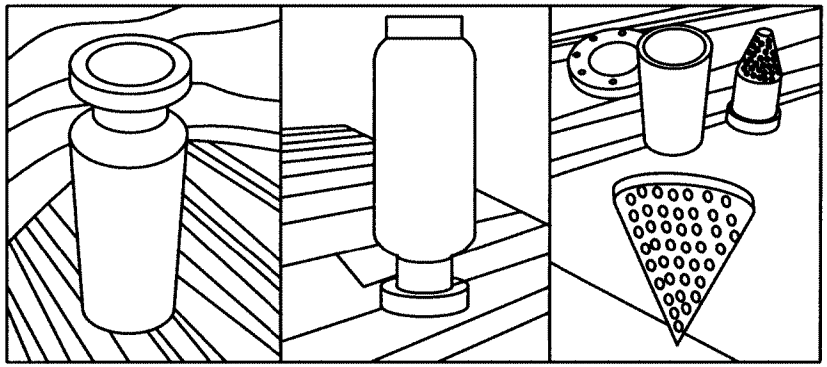
FIG. 3 depicts the suppressor container and telescopic dispersion nozzle used during the explosion test.

In order to introduce the flame inhibitors and/or other explosion mitigation agents into the module, an explosion suppression system was used. This system was provided by Kidde Brand-und Explosionsshutz GmbH, Germany, and the typical parts of this system are shown in FIG. 2. FIG. 3 shows the suppressor container and the telescopic dispersion nozzle used during the tests as it was installed and used in the experiments.

The inhibitor or mitigating agent was added to the container, which was then closed with a "high-pressure bursting disk". The container was then charged with nitrogen to 60 bar. Finally a "powder pack capsule" and gasket, with integral detonating cord and detonator, was fitted over the bursting disk and the entire system mounted onto the 5" flange on the roof of the module as indicated in FIG. 3.

The location of the dispersion nozzle was the same during all tests. The nozzle was mounted in the roof of the module, with the suppressor container outside, on top of the test volume. The location coordinates of the centre of the nozzle inlet was x=3.25 m, y=1.25 m.

The pressure sensor was mounted in the back wall of the upper deck, at x=2.25 m, y=2.50 m, z=2.10 m) The majority of the inhibitor tests were thus performed by force-triggering the suppression system with a pre-defined delay relative to the moment of ignition. This proved to be the only way of introducing the mitigation/inhibitor agents appropriately into the module given the restraints of the current test set-up.

Despite the satisfactory reproducibility and timing accuracy of the test control and switching system, small variations were observed between the time of activation of the ignition unit and the actual time of occurrence of the ignition spark. This was found to vary within the order of ±10 ms. The actual time of activation and firing of the inhibitor dispersion system thus had to be obtained from the measured data and quoted as an activation delay with respect to the time of the spark.

Flame Inhibitors and Mitigation Agents

Although the main aim of the current work was to test the mitigation properties of flame inhibitors, a number of tests were performed with pure water (without inhibitor salts) to provide a reference with waterspray. Two tests were performed using pressurised water only in the suppressor container. Also since the mitigating agent dispersion was from a pressured container, driven by nitrogen at a starting pressure of 60 barg, another reference condition was tested using nitrogen only, without water or inhibitor salts. Two tests were performed using nitrogen only.

In total, three different flame inhibitor compounds were tested during the current work. These were all tested as solids and one of them (potassium bicarbonate) was also tested in solution with water at several different concentrations. The main physical properties, in terms of moisture content and particle size distribution, for these inhibitor compounds are given in Table 2.1.

TABLE 2.1

Moisture content and sieving analysis results for particle size distribution for the three inhibitor compounds tested.

| Quantity/particle size range | Potassium bicarbonate | Sodium bicarbonate | Sodium Chloride |
|---|---|---|---|
| Moisture content (% w/w) | 0.09 | 0.01 | 0.00 |
| % < 1000 μm | 100 | 99.9 | 99.9 |
| % < 500 μm | 85.5 | 98.6 | 87.8 |
| % < 250 μm | 23.3 | 64.4 | 18.0 |
| % < 125 μm | 3.1 | 16.4 | 0.4 |
| % < 63 μm | 0.0 | 6.0 | 0.0 |

The inhibitor compounds were all tested as received/purchased. Conglomerates and lumps were however crushed prior to filling into the suppressor containers.

Instrumentation and Measurement Locations

The experiments were performed with explosive gas mixtures of methane in air and propane in air. The majority of the tests were performed using propane. Near stoichiometric mixtures were used in the tests (methane concentration=approx 9.5% vol, propane=approx 4.0% vol). The gas concentration of the mixtures was monitored using an infrared gas analyser (type Uras 10E).

The gas-air mixtures were ignited by a powerful oscillating high voltage electric spark. The ignition source was located just above the mezzanine deck near the south end of the module (position x=1.00 m, y=1.35 m and z=1.35 m).

The overpressure generated within the test module during the explosion tests was measured using 10 piezo-electric pressure transducers from Kistler (type 7261) connected to Kistler charge amplifiers (type 5007 and 5011). The signals from the pressure transducers were measured using the data acquisition system described below. The pressure transducers were mounted using five in the roof (P1, P3, P5, P7 & P9) and five in the back wall close to the lower deck (P2, P4, P6, P8 & P10). The coordinates of the pressure transducers are given in Table 2.2.

Purpose-built test control and data acquisition application programmes, based on multipurpose data acquisition card (PCI-6071) and relay switching cards from National Instruments together with the LabView programming platform were used to perform the experiments.

All tests were recorded using standard SVHS and digital video cameras (Panasonic SVHS and Sony DV camera). A majority of the tests were also recorded using a high-speed digital SLR camera (Casio).

TABLE 2.2

The x, y, z co-ordinate positions of the explosion pressure transducers inside the module (in m from the south-east corner, at lower deck floor level).

| Transducer ID | x | y | z |
|---|---|---|---|
| P1 | 7.85 | 1.47 | 2.50 |
| P2 | 7.85 | 2.50 | 0.48 |
| P3 | 6.15 | 1.46 | 2.50 |
| P4 | 5.85 | 2.50 | 0.48 |
| P5 | 3.85 | 1.25 | 2.50 |
| P6 | 3.85 | 2.50 | 0.48 |
| P7 | 2.36 | 1.25 | 2.50 |
| P8 | 2.15 | 2.50 | 0.48 |
| P9 | 0.13 | 1.47 | 2.50 |
| P10 | 0.13 | 2.50 | 0.48 |

Test Programme and Explosion Test Scenarios

The time at which the suppression/dispersion system was activated was varied since this proved to be a factor governing the mitigation behaviour of the inhibitor agents.

A total of 29 tests were performed in the current work. A breakdown of the tests is as follows:

- 3 tests in the low congestion, low confinement module configuration (all reference tests, no tests with inhibitors).
- 26 tests in the low congestion, high confinement module configuration (8 reference tests, 18 tests with inhibitors/mitigating agents).
- 2 tests with methane, 27 tests with propane.
- Of the 18 inhibitor tests, 2 were performed using nitrogen only, 2 with water only, 2 with potassium bicarbonate in aqueous solution and 12 tests were performed with dry inhibitor salts only (without water).
- Of the 12 tests with dry inhibitor salts, 1 test was performed with sodium chloride, 2 tests were performed using sodium bicarbonate and 9 tests were performed with potassium bicarbonate.

Tests 5-7, 15, 16, 21, 27 are made with propane and without inhibitor, tests 8, 12 are made with propane and water as inhibitor, tests 9, 24, 10, 13, 20, 14, 17, 18, 22-23, 25 are made with propane and KHCO3 as inhibitor, test 26 is made propane and NaCl as ihhibitor, tests 28-29 are made with propane and Na2CO3 as inhibitor, tests 11, 19, 1-2 are made and no inhibitor, tests 3-4 are made with methane and no inhibitor.

Summary of Measured Results

The following tables give a summary of the measured test results. Peak explosion pressures are given in Table 4.1 while the time of occurrence of the peak pressure relative to the moment of the ignition spark is given in Table 4.2. In said tables tests are referred as shot number.

TABLE 4.1

Summary of measured peak explosion pressure data

| Actual Shot | Peak Explosion Pressure | | | | | | | | | | Average Peak Pressure Values | | |
|---|---|---|---|---|---|---|---|---|---|---|---|---|---|
| Number | P1 (barg) | P2 (barg) | P3 (barg) | P4 (barg) | P5 (barg) | P6 (barg) | P7 (barg) | P8 (barg) | P9 (barg) | P10 (barg) | P1&P2 (barg) | P5&P6 (barg) | P7&P8 (barg) |
| 5 | 0.533 | 0.413 | 0.303 | 0.362 | 0.315 | 0.313 | 0.297 | 0.283 | 0.227 | 0.183 | 0.473 | 0.314 | 0.290 |
| 6 | 0.511 | 0.629 | 0.378 | 0.365 | 0.377 | 0.358 | 0.366 | 0.312 | 0.238 | 0.225 | 0.570 | 0.367 | 0.339 |
| 7 | 0.394 | 0.589 | 0.376 | 0.341 | 0.331 | 0.342 | 0.334 | 0.317 | 0.221 | 0.216 | 0.491 | 0.336 | 0.326 |
| 15 | 0.429 | 0.462 | 0.341 | 0.308 | 0.310 | 0.293 | 0.295 | 0.264 | 0.211 | 0.159 | 0.445 | 0.302 | 0.279 |
| 16 | 0.402 | 0.432 | 0.296 | 0.331 | 0.302 | 0.301 | 0.290 | 0.267 | 0.196 | 0.184 | 0.417 | 0.301 | 0.278 |
| 21 | 0.472 | 0.427 | 0.298 | 0.333 | 0.292 | 0.300 | 0.307 | 0.333 | 0.210 | 0.184 | 0.449 | 0.296 | 0.320 |
| 27 | 0.340 | 0.380 | 0.312 | 0.354 | 0.299 | 0.288 | 0.313 | 0.296 | 0.183 | 0.179 | 0.360 | 0.294 | 0.305 |
| 8 | 0.368 | 0.498 | 0.322 | 0.312 | 0.311 | 0.270 | 0.307 | 0.301 | 0.204 | 0.122 | 0.433 | 0.290 | 0.305 |
| 12 | 1.007 | 0.886 | 0.830 | 0.641 | 0.533 | 0.513 | 0.462 | 0.419 | n/a | 0.326 | 0.946 | 0.523 | 0.441 |
| 9 | 0.545 | 0.691 | 0.521 | 0.003 | 0.350 | 0.348 | 0.256 | 0.258 | 0.207 | 0.141 | 0.618 | 0.349 | 0.257 |
| 24 | 0.613 | 0.701 | 0.490 | 0.549 | 0.424 | 0.411 | 0.395 | 0.370 | 0.279 | 0.286 | 0.657 | 0.418 | 0.382 |
| 10 | 1.676 | 0.730 | 0.456 | 0.477 | 0.399 | 0.392 | 0.349 | 0.339 | 0.277 | 0.218 | 0.703 | 0.395 | 0.344 |
| 13 | 0.282 | 0.244 | 0.277 | 0.255 | 0.262 | 0.233 | 0.244 | 0.235 | 0.156 | 0.171 | 0.263 | 0.248 | 0.239 |
| 20 | 0.404 | 0.327 | 0.309 | 0.280 | 0.265 | 0.255 | 0.246 | 0.235 | 0.183 | 0.152 | 0.365 | 0.260 | 0.241 |
| 14 | n/a | n/a | n/a | n/a | n/a | n/a | n/a | n/a | n/a | n/a | #DIV/0! | #DIV/0! | #DIV/0! |
| 17 | 0.371 | 0.401 | 0.296 | 0.271 | 0.262 | 0.252 | 0.236 | 0.227 | 0.188 | 0.129 | 0.386 | 0.257 | 0.231 |
| 18 | n/a | n/a | n/a | n/a | 0.135 | 0.134 | 0.121 | 0.122 | 0.079 | 0.081 | #DIV/0! | 0.134 | 0.121 |
| 22 | 0.369 | 0.337 | 0.343 | 0.377 | 0.319 | 0.307 | 0.285 | 0.354 | 0.207 | 0.175 | 0.363 | 0.313 | 0.319 |
| 23 | 0.260 | 0.320 | 0.223 | 0.253 | 0.219 | 0.193 | 0.187 | 0.176 | 0.131 | 0.143 | 0.290 | 0.206 | 0.182 |
| 25 | 0.234 | 0.255 | 0.220 | 0.218 | 0.202 | 0.190 | 0.180 | 0.160 | 0.127 | 0.106 | 0.244 | 0.196 | 0.170 |
| 26 | 0.346 | 0.354 | 0.320 | 0.355 | 0.327 | 0.297 | 0.271 | 0.306 | 0.173 | 0.168 | 0.350 | 0.312 | 0.289 |
| 28 | n/a | n/a | 0.309 | 0.285 | 0.273 | 0.251 | 0.263 | 0.221 | 0.164 | 0.179 | #DIV/0! | 0.262 | 0.242 |
| 29 | n/a | n/a | 0.169 | 0.165 | 0.151 | 0.126 | 0.140 | 0.104 | 0.087 | 0.065 | #DIV/0! | 0.139 | 0.122 |
| 11 | n/a | n/a | n/a | n/a | n/a | n/a | n/a | n/a | n/a | n/a | #DIV/0! | *#DIV/0! | #DIV/0! |
| 19 | 0.367 | 0.523 | 0.324 | 0.379 | 0.326 | 0.314 | 0.299 | 0.303 | 0.188 | 0.187 | 0.445 | 0.320 | 0.301 |
| 1 | 0.108 | 0.122 | 0.069 | 0.061 | 0.024 | 0.027 | 0.004 | 0.023 | 0.013 | 0.016 | 0.115 | 0.026 | 0.013 |
| 2 | 0.100 | 0.100 | 0.066 | 0.032 | 0.023 | 0.027 | 0.018 | 0.020 | 0.013 | 0.022 | 0.100 | 0.025 | 0.019 |
| 3 | 0.045 | 0.048 | 0.026 | 0.022 | 0.010 | 0.014 | 0.010 | 0.013 | 0.008 | 0.005 | 0.046 | 0.012 | 0.011 |
| 4 | 0.218 | 0.240 | 0.174 | 0.216 | 0.169 | 0.189 | 0.182 | 0.192 | 0.127 | 0.102 | 0.229 | 0.179 | 0.187 |

TABLE 4.2

Summary of time of arrival of peak explosion pressure data

| Actual | Time of Arrival of Peak Explosion Pressures (relative to time of spark) | | | | | | | | | |
|---|---|---|---|---|---|---|---|---|---|---|
| Shot Number | t-P1 (s) | t-P2 (s) | t-P3 (s) | t-P4 (s) | t-P5 (s) | t-P6 (s) | t-P7 (s) | t-P8 (s) | t-P9 (s) | t-P10 (s) |
| 5 | 0.3202 | 0.3205 | 0.3206 | 0.3248 | 0.3230 | 0.3232 | 0.3245 | 0.3260 | 0.3272 | 0.3291 |
| 6 | 0.2932 | 0.2923 | 0.2949 | 0.2927 | 0.2962 | 0.2981 | 0.2980 | 0.2996 | 0.3002 | 0.3009 |
| 7 | 0.2864 | 0.2880 | 0.2902 | 0.2913 | 0.2913 | 0.2932 | 0.2964 | 0.2943 | 0.2962 | 0.2999 |
| 15 | 0.3058 | 0.3039 | 0.3063 | 0.3048 | 0.3076 | 0.3090 | 0.3096 | 0.3093 | 0.3110 | 0.3120 |
| 16 | 0.3010 | 0.3002 | 0.3017 | 0.3060 | 0.3041 | 0.3050 | 0.3056 | 0.3069 | 0.3085 | 0.3102 |
| 21 | 0.3135 | 0.3121 | 0.3136 | 0.3161 | 0.3165 | 0.3171 | 0.3182 | 0.3195 | 0.3196 | 0.3212 |
| 27 | 0.3050 | 0.3049 | 0.3048 | 0.3060 | 0.3081 | 0.3075 | 0.3099 | 0.3116 | 0.3019 | 0.3128 |
| 8 | 0.2967 | 0.2919 | 0.2926 | 0.2969 | 0.2946 | 0.2974 | 0.2985 | 0.2996 | 0.3008 | 0.2998 |
| 12 | 0.2738 | 0.2725 | 0.2787 | 0.2737 | 0.2755 | 0.2747 | 0.2766 | 0.2758 | ##### | 0.2769 |
| 9 | 0.1308 | 0.1336 | 0.1307 | 0.0947 | 0.1330 | 0.1308 | 0.1320 | 0.1369 | 0.1373 | 0.1373 |

TABLE 4.2-continued

| Summary of time of arrival of peak explosion pressure data | | | | | | | | | | |
|---|---|---|---|---|---|---|---|---|---|---|
| Actual | Time of Arrival of Peak Explosion Pressures (relative to time of spark) | | | | | | | | | |
| Shot Number | t-P1 (s) | t-P2 (s) | t-P3 (s) | t-P4 (s) | t-P5 (s) | t-P6 (s) | t-P7 (s) | t-P8 (s) | t-P9 (s) | t-P10 (s) |
| 24 | 0.2670 | 0.2672 | 0.2616 | 0.2665 | 0.2698 | 0.2700 | 0.2691 | 0.2716 | 0.2736 | 0.2731 |
| 10 | 0.1317 | 0.1329 | 0.1302 | 0.1303 | 0.1328 | 0.1357 | 0.1333 | 0.1363 | 0.1389 | 0.1380 |
| 13 | 0.2963 | 0.2968 | 0.3000 | 0.3002 | 0.3016 | 0.3006 | 0.3051 | 0.3054 | 0.3068 | 0.3073 |
| 20 | 0.3023 | 0.3006 | 0.3025 | 0.3016 | 0.3047 | 0.3051 | 0.3069 | 0.3059 | 0.3103 | 0.3114 |
| 14 | ##### | ##### | ##### | ##### | ##### | ##### | ##### | ##### | ##### | ##### |
| 17 | 0.2935 | 0.2913 | 0.2934 | 0.2940 | 0.2960 | 0.2955 | 0.2967 | 0.2933 | 0.3016 | 0.3017 |
| 18 | ##### | ##### | ##### | ##### | 0.3412 | 0.3370 | 0.2139 | 0.3310 | 0.3474 | 0.3289 |
| 22 | 0.2942 | 0.2903 | 0.2902 | 0.2923 | 0.2902 | 0.2949 | 0.2936 | 0.2976 | 0.2964 | 0.3027 |
| 23 | 0.2956 | 0.2986 | 0.2988 | 0.2983 | 0.3012 | 0.3006 | 0.3035 | 0.3025 | 0.3069 | 0.3029 |
| 25 | 0.3152 | 0.3148 | 0.3187 | 0.3153 | 0.3202 | 0.3175 | 0.3221 | 0.3229 | 0.3236 | 0.3129 |
| 26 | 0.2940 | 0.2939 | 0.2959 | 0.2954 | 0.2981 | 0.2976 | 0.3008 | 0.2997 | 0.2963 | 0.3049 |
| 28 | ##### | ##### | 0.2989 | 0.2988 | 0.3027 | 0.3007 | 0.3052 | 0.3027 | 0.3088 | 0.3065 |
| 29 | ##### | ##### | 0.3393 | 0.3378 | 0.1655 | 0.3425 | 0.3445 | 0.3433 | 0.3465 | 0.3301 |
| 11 | ##### | ##### | ##### | ##### | ##### | ##### | ##### | ##### | ##### | ##### |
| 19 | 0.3003 | 0.3006 | 0.2988 | 0.3008 | 0.3041 | 0.3022 | 0.2207 | 0.3055 | 0.3029 | 0.3060 |
| 1 | 0.3189 | 0.3206 | 0.3205 | 0.3211 | 0.3229 | 0.3232 | 0.1596 | 0.2915 | 0.2971 | 0.3045 |
| 2 | 0.3283 | 0.3318 | 0.3278 | 0.3280 | 0.3295 | 0.3306 | 0.3330 | 0.3322 | 0.3401 | 0.3411 |
| 3 | 0.4139 | 0.4225 | 0.4136 | 0.4122 | 0.3805 | 0.3778 | 0.4270 | 0.3797 | 0.4286 | 0.3826 |
| 4 | 0.4026 | 0.4048 | 0.4042 | 0.4056 | 0.4078 | 0.4070 | 0.4096 | 0.4100 | 0.4117 | 0.4111 |

The above tables 4.1 and 4.2 show clearly that the peak explosion pressure and the arrival of peak explosion pressure are highly reduced when the flame acceleration suppression product is introduced in the flammable gas.

The invention claimed is:

1. A method to mitigate the consequences of an unconfined or partially confined vapor cloud explosion due to the accidental release of a flammable gas in an open area, wherein:

means capable to release a flame acceleration suppression product are dispersed in said area, wherein the flame acceleration suppression product is mixed with primary anti-oxidants and/or secondary antioxidants, a signal is generated by a detector of said flammable gas release, or by an operator, or by an approaching flame or by the explosion itself, or by any combination thereof, said signal activates the release of the flame acceleration suppression product in said area and in an amount capable of transforming a flammable cloud into a mixture of flammable product, air and said flame acceleration suppression product to prevent flame accelerations in the unconfined vapor cloud explosion but to let the flammable product burn in case of ignition.

2. The method according to claim 1 wherein the means capable to release a flame acceleration suppression product are one or more vessels containing a flame acceleration suppression product dispersed in said area, said vessels comprising one or more openings closed with rupture disks and means to rise sharply the pressure inside said vessels, the signal generated by a detector of said flammable gas release, or by an operator, or by an approaching flame or by the explosion itself, or by any combination thereof, activates the means to rise sharply the pressure inside said vessels so as to have the bursting of the rupture disks and the flame acceleration suppression product dispersed in said area.

3. The method according to claim 1 wherein the release of the flame acceleration suppression product is made by the signal generated by the detector of said flammable gas release or by the operator and is made before ignition or beginning of an explosion.

4. The method according to claim 1 wherein the flame acceleration suppression product is a solid in a powder form.

5. A method to mitigate the consequences of an unconfined or partially confined vapor cloud explosion due to the accidental release of a flammable gas in an open area, wherein:

means capable to release a flame acceleration suppression product are dispersed in said area, wherein the flame acceleration suppression product is selected among sodium bicarbonate ($NaHCO_3$), potassium bicarbonate ($KHCO_3$), sodium chloride and sodium carbonate, a signal is generated by a detector of said flammable gas release, or by an operator, or by an approaching flame or by the explosion itself, or by any combination thereof, said signal activates the release of the flame acceleration suppression product in said area and in an amount capable of transforming a flammable cloud into a mixture of flammable product, air and said flame acceleration suppression product to prevent flame accelerations in the unconfined vapor cloud explosion but to let the flammable product burn in case of ignition.

* * * * *